United States Patent [19]

Berenov et al.

[11] 4,294,306

[45] Oct. 13, 1981

[54] WITHDRAWAL ROLL UNIT FOR HORIZONTAL CONTINUOUS BILLET CASTING MACHINES

[76] Inventors: Alexandr D. Berenov, ulitsa Krasnykh Bortsov, 7-a, kv. 18; Vladislav P. Krainev, ulitsa Lunacharskogo, 210-a, kv. 24; Midkhat M. Mansurov, ulitsa Izbiratelei, 7, kv. 23; Vitaly M. Niskovskikh, ulitsa Kultury, 8, kv. 8; Evgeny L. Silin, ulitsa Kultury, 22, kv. 9, all of Sverdlovsk, U.S.S.R.

[21] Appl. No.: 75,712

[22] Filed: Sep. 14, 1979

[51] Int. Cl.[3] ..... B22D 11/00; B22D 29/00; B65G 13/11

[52] U.S. Cl. ..... 164/448; 72/78; 144/208 E; 144/246 F; 193/35 R; 198/782; 198/785

[58] Field of Search ..... 164/442, 448, 440; 193/35 R, 35 C; 198/624, 780, 782, 785; 414/14, 18, 745; 144/208 E, 246 R, 246 F; 72/78, 246; 226/179, 189, 190, 191, 192, 168

[56] References Cited

U.S. PATENT DOCUMENTS

| | | | |
|---|---|---|---|
| 2,353,125 | 7/1944 | Carpmail | 144/208 E |
| 2,664,215 | 12/1953 | Bottenhorn | 198/780 X |
| 2,725,908 | 12/1955 | Ednell et al. | 144/208 E |
| 2,897,859 | 8/1959 | Annis, Jr. | 144/246 F X |
| 3,631,916 | 1/1972 | Schwartz | 164/448 |
| 3,810,376 | 5/1974 | Elle | 72/246 X |
| 4,156,453 | 5/1979 | Scheinecker | 164/448 |

FOREIGN PATENT DOCUMENTS

| | | | |
|---|---|---|---|
| 1269929 | 7/1961 | France . | |
| 260868 | 5/1970 | U.S.S.R. | 144/208 E |

*Primary Examiner*—Robert D. Baldwin
*Assistant Examiner*—Gus T. Hampilos
*Attorney, Agent, or Firm*—Fleit & Jacobson

[57] ABSTRACT

The present invention is used in continuous casting machines where a billet is withdrawn from a mould and simultaneously rotated about its own axis. The invention provides a withdrawal roll unit that has withdrawal rolls mounted on oscillating levers or housings cantilevered on a rotating cage. The levers, with the withdrawal rolls, are located in a plane perpendicular to the axis of rotation of the cage. The ends of the levers are connected in series one to another. In one embodiment, a second end of each lever or housing is connected by an elastic element to a first end of an adjacent lever which, in turn, is secured to the cage.

2 Claims, 3 Drawing Figures

WITHDRAWAL ROLL UNIT FOR HORIZONTAL CONTINUOUS BILLET CASTING MACHINES

BACKGROUND OF THE INVENTION

1. Field of the Invention

The invention relates to metallurgy and more particularly to withdrawal roll units of continuous metal casting machines.

The present invention can find an effective application in horizontal continuous metal casting machines, especially in those continuous casting machines where ingots are withdrawn from moulds and simultaneously rotated about their own axes.

2. Description of the Prior Art

Horizontal continuous casting machines are currently finding an extensive use for casting ferrous and nonferrous metals and alloys. These machines present a number of substantial advantages as compared to existing types of continuous metal casting machines (small height of column of molten metal in the machine which greatly simplifies the design of the machine, lesser requirements in metal for manufacturing the machine, no open meniscus of molten metal in mould, simple operation).

Easy operation of continuous casting machines, their reliability and stability of operation, excellent quality of cast ingots and the cost of the machine as a whole are greatly dependent upon the design of one of the main mechanisms of the machine—the withdrawal roll unit.

There are known withdrawal roll units comprising withdrawal rolls secured to oscillating levers mounted on a rotating cage.

U.S. Pat. No. 1,269,929 (France), cl. B 22 d, describes a withdrawal roll unit, wherein two withdrawal rolls are secured to oscillating levers, and the levers, in their turn, to a rotating cage, parallelly to the axis thereof and, therefore, parallelly to the process axis of the machine. The withdrawal rolls and the cage are rotated through a system of spur and bevel gears.

A material disadvantage of this type of withdrawal roll unit is the location of the oscillating levers with secured thereto withdrawal rolls longitudinally of the process axis of the machine. The longitudinal location of the oscillating levers, first, increases the dimensions of the machine longitudinally of the process line, this making the whole of the process line longer; second, such an arrangement of the oscillating levers complicates the design of the withdrawal roll drive. The design of the withdrawal roll unit admits of not more than two withdrawal rolls, so that the pressure the rolls exert upon an ingot being cast to ensure the withdrawal thereof from a mould may be so great as to mar the quality of the ingot surface.

SUMMARY OF THE INVENTION

It is therefore an object of the invention to reduce the dimensions of the withdrawal roll unit longitudinally of the process axis of a horizontal continuous casting machine.

Another object of the invention is to simplify the design of the withdrawal roll drive.

Still another object of the invention is to design such a withdrawal roll assembly where the loads would be evenly distributed among the rolls in the process of withdrawal of an ingot being cast from a mould.

Yet another object of the invention is to reduce the pressure each roll exerts upon an ingot, as it is being withdrawn from a mould.

The above and other objects are attained in a withdrawal roll unit of a horizontal continuous casting machine, comprising live rolls mounted on oscillating levers cantilevered in a rotating cage, and a differential withdrawal roll unit drive, according to the invention, the oscillating levers with live rolls being located in a plane perpendicular to the axis of rotation of the cage, the ends of the levers being connected in series one to another to form a closed system.

The above design of the withdrawal roll unit greatly reduces the longitudinal dimensions thereof and simplifies the design of the withdrawal roll drive.

The arrangement of the oscillating levers also makes possible to mount more than two rolls without complicating excessively the withdrawal roll drive system. A greater number of rolls distributes more evenly the pressure throughout the perimeter of an ingot, as it is being withdrawn from a mould and reduces the pressure each roll exerts upon the ingot.

In accordance with one of the embodiments of the present invention, the free end of each lever is connected to the end of an adjacent lever, secured to the cage, by an elastic element, so as to apply the load uniformly to all the rolls.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 1:
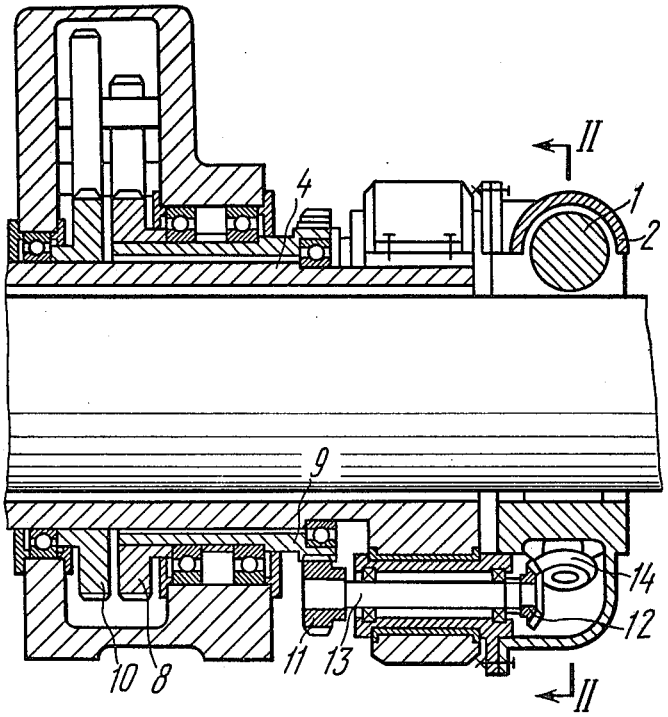
FIG. 1 is a longitudinal section of a withdrawal roll unit, according to the invention.
Figure 2:
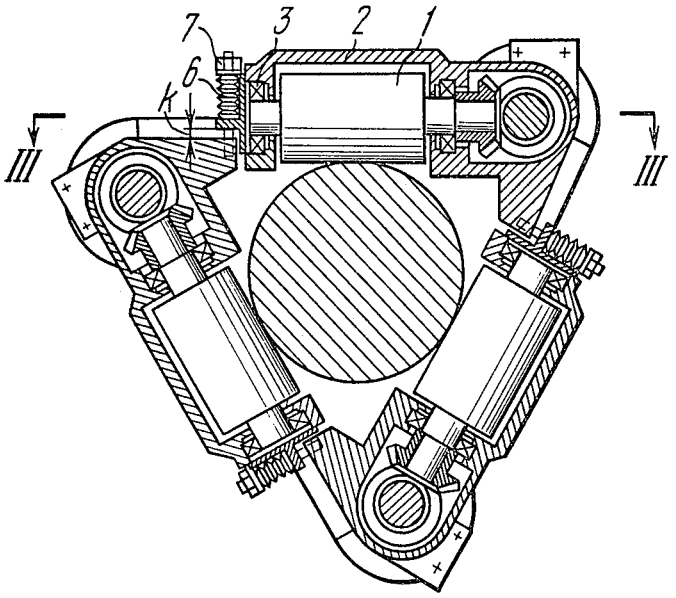
FIG. 2 is a section through II—II on FIG. 1.
Figure 3:
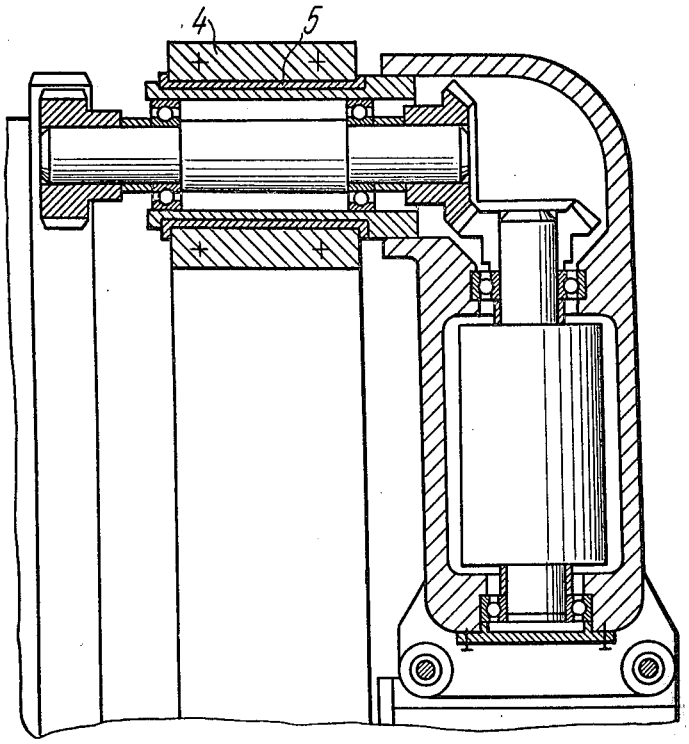
FIG. 3 is a section through III—III on FIG. 2.

A withdrawal roll unit of a horizontal continuous casting machine comprises withdrawal rolls 1 (FIGS. 1, 2, 3) mounted in a housing 2 in rolling friction bearings 3. The housing 2, which functions as an oscillating lever, is connected by one of its ends to a cage 4 by means of a sliding friction bearing 5 and is capable of a free rotation, whereas the free end of the above housing 2 is connected to a housing 2 of an adjacent roll 1 by an elastic element 6. The tightening of the elastic element 6 can be adjusted by a nut 7. The elastic element 6 may be, for example, a disk spring. The levers 2 with the withdrawal rolls 1 are located in a plane perpendicular to the axis of rotation of the cage.

A driving gear 8 of a differential drive is rigidly attached to a central gear 9. A driving gear 10 is rigidly connected to the cage 4. A pinion 11 meshing with the central gear 9 is coupled rigidly with a bevel gear 12 through a shaft 13. The bevel gear 12, in its turn, meshes with a bevel gear 14 set on the withdrawal roll 1.

OPERATION

The withdrawal roll unit operates in the following manner. Once a dummy bar is introduced into a mould and molten metal is fed thereto (the dummy bar and the mould are omitted on the drawing), the differential drive of the unit is energized. The torque of the drive is transmitted via the gears 8 and 9 to the pinion 11 and, through the shaft 13, to the bevel gear 12, then to the bevel gear 14 rigidly coupled with the withdrawal roll 1. As the withdrawal rolls rotate, they pull out the dummy bar together with an ingot from the mould. The withdrawal rolls 1 are mounted on the rotating cage 4, which, in its turn, is actuated by a drive (not shown on the drawing) through the gear 10, so that the ingot is rotated, as it is being withdrawn from the mould. The force with which the rolls 1 bear upon the ingot can be adjusted by the nut 7 and the elastic elements 6.

The axis of rotation of the cage 4 is aligned with the longitudinal axis of an ingot being cast.

When an ingot of a different cross sectional area is to be cast, the withdrawal rolls 1 are brought together or the dimension "K" (FIG. 2) is adjusted accordingly by varying the thickness of liners (not shown on the drawings) placed between the housings 2 of the preceding and subsequent withdrawal rolls.

What is claimed is:

1. A roll unit for withdrawing billets from a horizontal continuous billet casting machine comprising:

a cage rotatable about an axis of a billet being withdrawn;

means operative during withdrawal of a billet for associated with said cage and being rotating said cage about said axis;

a plurality of withdrawal rolls having coplanar axes of rotation located in a plane perpendicular to said billet axis;

means associated with said rollers for driving said rollers;

a plurality of housings, each of said housings at least partially encompassing and rotatably supporting ends of one of said withdrawal rolls;

means associated with said cage and housings for connecting corresponding first ends of each of said housings to said cage; and means comprising an elastic element associated with each of said housings for connecting confronting ends of said housings in series one to another to form a closed system about the axis of the billet.

2. A roll unit according to claim 1, wherein said means for connecting confronting ends comprises means for adjusting the force exerted by said elastic element.

* * * * *